United States Patent [19]

Ramani

[11] Patent Number: 4,494,369

[45] Date of Patent: Jan. 22, 1985

[54] SPINNING POT USED FOR TWISTING AND WINDING SYNTHETIC TEXTILE YARNS

[75] Inventor: Rajan V. Ramani, Bangalore, India

[73] Assignee: Council of Scientific and Industrial Research, New Delhi, India

[21] Appl. No.: 426,729

[22] Filed: Sep. 29, 1982

[51] Int. Cl.[3] ..... D01H 7/80

[52] U.S. Cl. ..... 57/76

[58] Field of Search ..... 57/76, 77

[56] References Cited

U.S. PATENT DOCUMENTS

| | | | |
|---|---|---|---|
| 1,385,306 | 7/1921 | Clayton | 57/76 |
| 1,822,194 | 9/1931 | Bauriedel et al. | 57/77 |
| 1,962,935 | 6/1934 | Richardson | 57/76 |

FOREIGN PATENT DOCUMENTS

| | | | |
|---|---|---|---|
| 891344 | 3/1962 | United Kingdom | 57/76 |

*Primary Examiner*—John Petrakes

*Attorney, Agent, or Firm*—Fleit, Jacobson, Cohn & Price

[57] ABSTRACT

In known spinning pots the barrel has an integral base and while the barrel portion may withstand stresses caused by centrifugal forces exerted by the wet cake expanding, the flat bottom base is unable to do so. When discarding the pot, the base also has to be discarded. The present invention provides a spinning pot in which the base is formed separate from a cylindrical barrel and the two are connected by a locating driving spigot. Additionally the base is provided with a bushing in two parts, the wearing part is removably fitted on the main part which is integral with the base.

8 Claims, 4 Drawing Figures

SPINNING POT USED FOR TWISTING AND WINDING SYNTHETIC TEXTILE YARNS

BACKGROUND OF THE INVENTION

1. Field of Invention

This invention relates to an improved spinning pot used for twisting and winding synthetic textile yarns. The "SPINNING POTS" are used for high speed spinning of yarn in textile industries in general and viscose yarn industries in particular.

2. Description of the Prior Art

As per known art, the spinning pots have been used for decades in large or small textile mills. The known pot forms a unitary construction or a cylindrical portion and the base plate therefor. It is mounted on a pot motor with its rotating axis vertical and driven at high speeds of rotation, typically 8000 rpm. Textile yarn filaments coming out of spinnerettes are directed through a funnel, to initially drop to the centre of the bottom surface of the pot where they are thrown outwards to the wall of the spinning pot by the centrifugal force due to high speed rotation of the pot. A periodic reciprocating motion, given to the funnel along the axis of the pot, winds the spun filament yarn into a helically wound 'cake' which builds up uniformly along the internal wall of the spinning pot. The acidic liquid which is picked up by the yarn when it comes out of the coagulating bath is, to a large extent, removed from the 'cake' by centrifugal action and thrown out through vent holes on the walls of the spinning pot.

The known spinning pot consists of a barrel having an integral base which is mounted on the shaft of a pot motor by means of a locating bush. There is also provided the usual air vent, acid vent and centre spot. The walls of the barrel of the pot have a plurality of stiffening reinforcements. The pot at the top has a lid, with a locking ring therefor. A funnel and funnel holder are fixed in the said lid for the admission of the yarn. The twisted yarn forms a cake on the inside of the pot.

All known pots now in use are essentially similar in shape and construction. The differences are generally limited to the type of central mounting bush, type of vent holes for excess acid or air, type of reinforcement to make the wall stiffer, type of closure at the top and its retention etc.

Thus, in order to make use of the known pots with the existing components involves the following sequence of steps in its operation:

(i) remove the entire spinning pot from the motor shaft;

(ii) remove locking ring;

(iii) remove lid;

(iv) turn pot upside down;

(v) lightly tap on a soft smooth surface and remove cake.

For starting the cycle of operation, the same sequence in reverse order has to be gone through.

When we consider that the cycle of operation is repeated by thousands of operators millions of times all over the world, saving in operator fatigue and production time is of great importance.

The drawbacks of the hitherto known spinning pots are:

The spinning pot is a highly stressed component which is subjected to cyclic loading of continuous duty;

All existing pots have the common drawback of high stress concentrations at the corner where the cylindrical wall meets the flat circular base;

Also the barrel portion of the vessel which is stressed to the highest level by the centrifugal force exerted by the wet cake, tends to expand into a large cylinder. But the flat circular bottom disc cannot expand equally. This leads to high flexural and shear stresses at the junction of the barrel and its flat circular base;

Furthermore, the base of the pot has large mass of costly acid resistant material which is discarded along with the condemned pots;

The bronze metal bush which is critically precision machined after fixing to the pot is of considerable cost and it is also discarded everytime a pot's life is over. Although the metal can be recovered, the recovery value is a minute fraction of the original cost;

The locating bore and face, being small in dimension have to be very accurate to have the pot run concentrically and in dynamic balance. Even small amount of wear in the bore tends to offset the concentricity and balance of the pot, leading to costly repair work of, (i) rebushing the pot and (ii) re-balancing of the pot dynamically;

The existing pots typically weigh about 2 to 3 times the weight of the cake that is formed by spinning. As the operator takes out the entire pot to remove the cake for further processing, it means that the operator handles 2 to 3 times excess load twice for every cake for yarn produced. Although this looks trivial, it is of enormous magnitude, when one considers the total volume of production which runs into thousands of tons per day, affecting thousands of workers, who have to work in continuous exposure to acid fumes in the spinning section of the mill;

The existing pots also consume work energy for the following reasons:

(i) As the weight of the pot is high, the power for accelerating it to the top speed is high;

(ii) As the shape is such that both outer and inner contours cannot be given very smooth surfaces, the practice is to mould the inner surfaces to mirror finish and machine the outer contour by turning and polishing it by sanding;

(iii) As most of the energy consumed during the spinning is for overcoming the aerodynamic friction which is related to the smoothness of the surfaces and accuracy of concentric rotation, mirror smooth finish on all surfaces of the pot will result in substantial saving in energy consumption. As millions of spindles are in operation all over the world on continuous duty, the saving potential is enormous.

SUMMARY OF THE INVENTION

The main object of the invention is to eliminate the stress concentration and high levels of flexural and shear stresses at the corner junction between the barrel and disc portions of the spinning pot.

The other objects of this invention are to:

(i) improve the surface finish and concentricity of all rotating surfaces;

(ii) reduce the weight of the expandable portion of the pot;

(iii) improve the locating arrangement;

(iv) reduce the cost of manufacture of the pots;

(v) reduce the cost of raw materials used in the manufacture of the pots;

(vi) reduce the energy consumption in the use of the pots in a textile mill;

(vii) improve the safety of the pot by controlling failure mode;

(viii) reduce operator fatigue.

The basic principle of the invention is to isolate the two areas of stress levels by having the pot as a near cylindrical vessel with both ends open and removably attached to the base plate.

The novel results thus achieved in this invention are:

(i) improved surface finish and concentricity of the critical part, the conical cylinder (or barrel minus the base) which is an open nearly cylindrical tube lends itself to a high finish on all concentric surfaces, without much difficulty;

(ii) the conical cylinder can be made of considerably less weight than that of the known pots;

(iii) the location of the conical cylinder on a spigot through large locating surfaces result in more precise alignment of the axes of rotation;

(iv) cost of manufacture is reduced very much as the parts are simpler to manufacture and it is easier to control their quality;

(v) cost of raw materials is also reduced as the critically stressed component, namely the conical cylinder only is to be made of costly material;

(vi) energy consumption is reduced due to less weight and better surface finish;

(vii) operator safety is increased because the stress concentrations are reduced and failure mode is controlled;

(viii) operator fatigue is reduced as he has to handle reduced weight per working cycle.

Accordingly this invention provides an improved spinning pot used for twisting and winding synthetic textile yarns which comprises a barrel, with both top and bottom ends open, said barrel being removably mounted on a rotatable base plate by means of a locating spigot means; as said base plate having a locating bush made of two parts consisting of a fixed bush portion integral to the said base plate and a removable bush portion on said fixed bush portion. Spinning pot is fixed on the spindle of a high speed motor by means of said locating bush.

The assembly of the barrel and the base plate is fixed on the spindle of a high speed motor by means of the said locating bush.

According to another feature of the invention the barrel is in the form of a conical cylinder which is provided with stiffening reinforcements to withstand stress exerted by the centrifugal force due to expansion of barrel during operation, said reinforcement being independent of the flat circular bottom disc, and has a concentric locating step for the lid with a groove for a locking ring therefor.

According to still another feature of the invention a locking means are provided for locking the barrel to the base plate at the spigot.

According to a further feature of the invention the locking means consist of a plurality of fingers within the base plate and an annular groove therefor on the conical cylinder bottom portion of the barrel.

According to still another feature of the invention the spigot is in the form of a tapered or cylindrical cross-section to form the joint between the barrel and the base plate.

The removable bush portion can be disposed of due to wear and tear and replaced by a new portion for easy repairs thereof.

DETAILED DESCRIPTION

Figure 1:
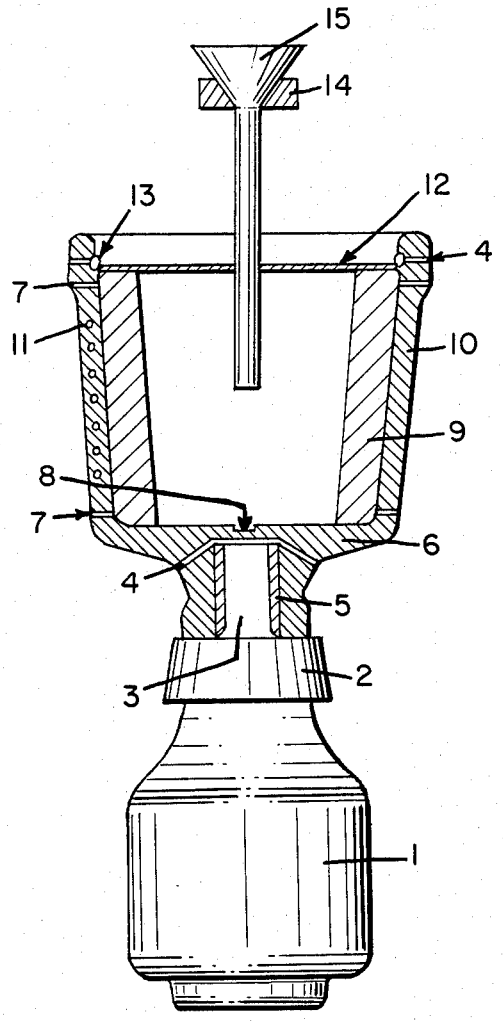
PRIOR ART FIG-1.
FIG. 1 illustrates a known spinning pot.

Referring to FIG. 1, a spinning pot consist of a barrel 10 having an integral base 6 mounted on shaft 3 of a pot motor 1, with a skirt 2, by means of a locating bush 5. It has the usual air vent 4, acid vent 7 and centre spot 8. The walls of the barrel 10 have a plurality of stiffening reinforcements 11. Lid 12 at the top of barrel 10 has a locking ring 13 and is provided with a funnel 15 and funnel holder 14. The funnel 15 is for admission of the yarn. Twisted yarn in the pot forms a Cake 9 on the inside of the pot.

Figure 2:
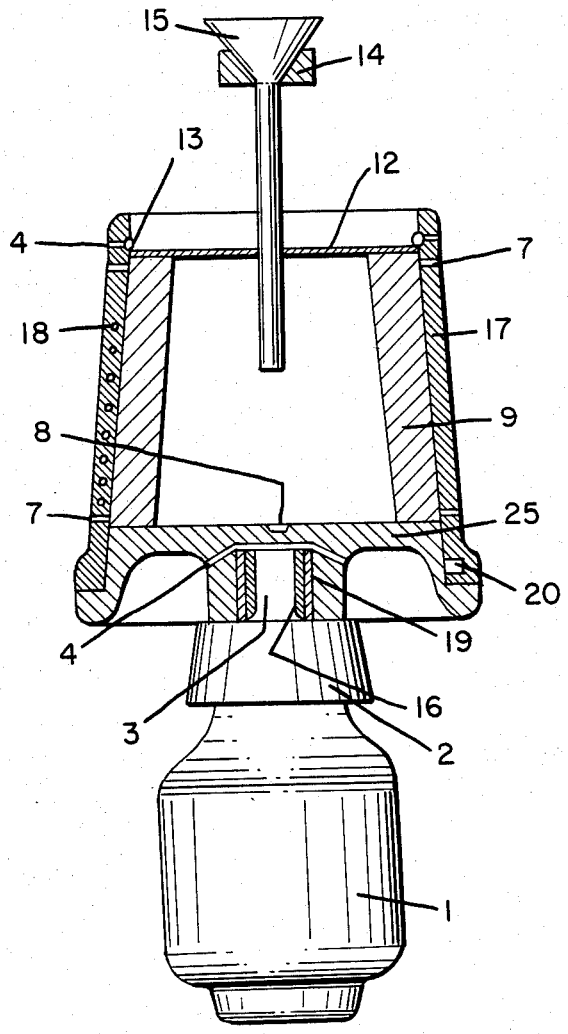
FIG. 2 illustrates a spinning pot according to an embodiment of this invention.
Figure 3:
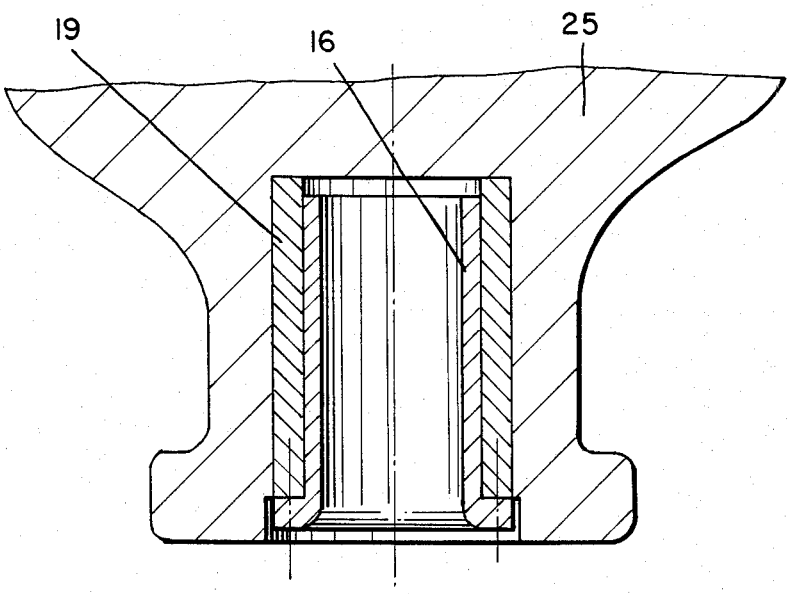
FIG. 3 is sectional view of a part of the spinning pot shown in FIG. 2.
Figure 4:
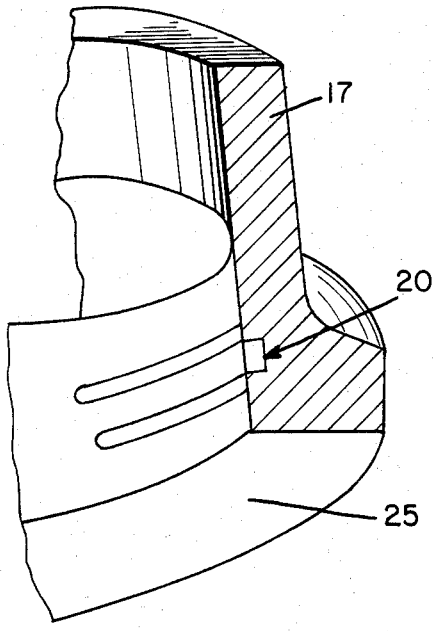
FIG. 4 shows locating spigot means for mounting the pot to a base.

As stated above, in the pot of this invention, as shown in FIGS. 2 through 4, the pot comprising the barrel is a conical cylinder 17 with both top and bottom ends open and top fitted with a lid 12 and locking ring 13. Funnel 15 and funnel holder 14 are in the lid 12. The barrel 17 is removably mounted on a rotatable base 25 by means of a locating spigot means 20, more clearly seen in FIG. 4. A locating bush comprising of a fixed bush portion 19 is integrally formed with the base 25. A removable bush portion 16 is mounted on the integral bush 19. Base 25 has a centre spot 8, as usual.

In place of tapered spigot 20 as shown, a cylindrical spigot may be used.

The separation of the barrel from the base by the combination of the parts to form the pot results in the elimination of high stresses at the joint between the barrel and the base.

The conical cylinder (17) of the improved pot is free to expand under hoop stress developed as a result of the centrifugal force exerted by the cake (9) during high speed rotation. Since this is not rigidly attached to the base, the latter is subjected to a much lower load and thus there is no stress concentration.

Essentially the functions of the new parts are same as those of the known device, namely, the twisting and winding of the yarn. The innovation results in a more reliable, less expensive and safer apparatus.

In the constructional detail the base (25) is mounted on the shaft (3) of pot motor (1) accurately concentric to the axis of rotation. The conical cylinder (17) is located on the base accurately concentric by engagement with the spigot (20). The rotation of the motor shaft (3) is transmitted to the conical cylinder (17) through the base (25) and the whole assembly is rotated at high speed to start the working cycle.

The untwisted bundle of fibres is directed through the funnel (15) on to the centre spot (8) on the base where the fibre bundle is thrown outwards radially to the wall of the conical cylinder (17) by the centrifugal action of the rotating mass. The funnel (15) is given a reciprocating to and fro motion along the axis of rotation, thus forming the fibres into a wound cake (9).

In use, the spigot is mounted on the spindle of the pot motor on a semi-permanent basis. It will normally be necessary to remove it only for (i) resurfacing of the protective layer and/or (ii) replacing of the bush.

The conical cylinder (17), being nearly cylindrical in shape with a slight taper for release of the cake of yarn (9), is moulded from suitable acid resistant-plastic materials with directional reinforcement. The lid (12) is a circular disc of acid resistant plastic. The locking ring (13) is a plastic or rubber ring of suitable acid resistance.

The driving spigot 20 is moulded from similar material as the barrel but without directional reinforcement. The protective layer may be of PTFE (TEFLON) polyurathane or similar hard wearing, acid and abrasion resistant material in the form of a film which is adhesively bonded to the top surface of the spigot.

The base (25) is moulded from similar material as the conical cylinder (17) but does not need directional reinforcement. The base (25) consists of the following: the top surface which is highly polished and flat with a thin protective layer of a suitable film typically polyester, PTFE (TEFLON), polyurethene etc. The centre spot 8 of moulded plastic of contrasting colour is fixed concentric to the locating spigot (20) in a recess at the centre of the top surface. The locating bush 19 is a phospher bronze or similar wear resistant bearing material and has a precisely machined bore which is concentric to the locating (driving) spigot (20). The removable bush (16) is a closely fitting sleeve of similar material to the locating bush (19). The removable bush is accurately machined such that when fitted into the locating bush 19 the bore of the removable bush (16) is concentric to the locating spigot (20).

In use, the base (25) is mounted on the motor shaft (3) of the pot motor (2), on a semipermanent basis. It will normally be necessary to remove it only for (i) resurfacing of the protective layer and/or (ii) replacing the removable bush (16).

The locating spigot (20) in the base (25) has a cylindrical (or slightly conical) step and a square face which together are the locating reference surfaces to locate the conical cylinder (17) accurately concentric to the axis as defined by the motor shaft (3).

The conical cylinder (17) is a precision moulded, smooth surfaced, hollow cylinder with close fitting circular locating diameter at the bottom with a corresponding square face which together when fixed to the locating spigot (20) ensure concentricity of rotation.

The locating spigot (20) may be of two closely fitting conical surfaces instead of cylindrical surfaces for easy assembly and removal.

The lid (12), locking ring (13) etc. are of conventional design and are not relevant to this invention.

When in operation, the high speed rotation of the pot exerts a centrifugal hoop stress on the conical cylinder (17) due to (i) its own mass rotating at high angular velocity, and (ii) the slowly forming wet formed cake (9) of yarn. While (i) is constant during most of the cycle of operation, (ii) increases as the mass of the cake increases to a maximum value when the cycle is completed and the rotation stopped. During this cycle of increasing hoop stress, the conical cylinder (17) is free to expand concentrically without affecting the dynamic balance of the whole system. This results in elimination of regions of abrupt stress changes.

At the end of the cycle, the conical cylinder (17) along with the fully formed cake (9), lid (12), and locking ring (13) is removed from the base (25) and the cake (9) is released by a light tap against a soft, smooth surface. This releasing operation involves only lifting and lateral movement.

The locating spigot 20 has a cylindrical step and a square surface which are accurately concentric and square to the rotating axis as defined by the bush/pot motor spindle.

The barrel (conical cylinder) 17 is a precision moulded smooth surfaced hollow cylinder with close fitting circular locating diameter at the bottom with a corresponding square face which together when kept on the spigot ensure that the axis of the barrel will be accurately aligned with the rotating axis.

The locating spigot 20 may be made of two closely fitting conical surfaces instead of cylindrical surfaces for easy assembly and removal.

The lid, locking ring etc. are of conventional design and not relevant to this invention.

When in operation the high speed rotation of the pot exerts a centrifugal hoop stress on the barrel due to (i) its own mass rotating at high angular velocity and (ii) the slowly forming mass of the partially wet cake of yarn. While (i) is constant during most of the cycle of operation, (ii) increases as the mass of the cake increases to a maximum value when the cycle is completed and the rotation stopped. During this cycle of increasing stress the barrel is allowed to expand freely and concentrically without effecting the dynamic balance. As there is no region of abruptly changing stresses, the critical stress concentration, high flexural/shear stresses mentioned above are non-existant in this invention.

At the end of the cycle the barrel 17 along with the fully formed cake 9, lid 12 and locking ring 13 is removed from the spigot 20 and a light tap against a smooth, soft surface releases the cake. The barrel 17 is again put on the spigot 20 to start the next cycle of operation.

The direct new results exclusively flowing from the spinning pot of this invention are:

(i) elimination of concentration of stress and resultant high stress areas in the spinning pot;

(ii) simplified manufacturing process, typically by a factor of 10 in terms of man-machine hours;

(iii) reduction in materials used, typically by a factor of 2 in terms of cost;

(iv) reduction in weight of the pot, typically by a factor of 2;

(v) reduction in aerodynamic drag, typically by 25% leading to reduction in power consumption, which will have to be worked on the basis of extensive trials;

(vi) reduction in operator fatigue due to reduction in weight handled per cycle;

(vii) increase in plant safety because of elimination of stress concentration and high levels of stresses in operation;

(viii) longer life at lesser cost for the pots because of points listed above.

Directly as a result of the invention, the following modifications to the spinning mill equipment will lead to overall improvements of considerable magnitude:

(i) The base (Ref. FIG. 1) will be of simple moulded plastic with the precision locating bush fitted and bored accurately.

(ii) As only the metallic bush is a wearing component this could be made as a replaceable component in such a way that a readymade square could be fitted to replace a worn out bush, without subsequent boring, balancing, etc. (see FIG. 3).

(iii) The top surface of the base disc which is subject to erosion due to impingement of acid and fibre, is protected by a wear resistant, smooth layer of thin plastic film, which is bonded with a suitable adhesive in such a way that when it has become rough in course of time, the layer is removed by a suitable solvent and a fresh layer bonded again. This leads to very long life of the base.

The conical cylinder (17) being open at both ends is amenable to simpler and more accurate methods of manufacture as well as better surface smoothness on internal as well as external surfaces.

The base (25) also is of simpler design and being a low stress part, is capable of being made from cheaper materials in more productive methods of manufacture.

The accurate location of the conical cylinder (17) to the base (25) through the locating spigot (20) of large reference surfaces makes it very simple to get proper concentricity and dynamic balance.

As the base (25) is generally left fixed on the motor shaft (3) there is less chance of inaccuracies of location due to mishandling.

The removable bush (16) is the only wearing part and is made such that it is very cheap and economical to replace compared to the conventional cost of rebushing.

The barrel is made of high strength unidirectional fibres reinforced with plastic resin.

The high strength fibre used can be glass fibres, carbon fibre, basalt, graphite fibre, boron fibre, organic fibres like 'KEVLAR', natural fibres like asbestos, cotton, jute or sisal either alone or in combination thereof.

The resin used may be phenolic, polyester epoxy, silicone, or similar acid resistant thermosetting plastic. The barrel is thus made by filament winding of fibres.

The fibrous reinforcements of the barrel are impregnated with the resins either before winding or after winding by resin injection.

The barrel is made by moulding of macerated cloth impregnated with plastic resin and is further reinforced with high tensile stainless or other steel wire coiled and placed concentrically in the middle of the cylindrical wall of the barrel.

The high tensile strength is due to the use of carbon, graphite, boron or organic fibre (KEVLAR).

The cylindrical wall of the barrel has plurality of holes to allow the acidic residue to be thrown out by the centrifugal action of the spinning pot.

The locking mechanism may consist of a groove in the barrel portion of the spigot 20 and plurality of fingers in the base disc. These fingers, are fixed to the base disc in such a way that normally, when the pot is at rest they do not project into the spigot groove in the barrel. When the pot rotates at high speed the free ends of the fingers move radially outwards into the corresponding groove in the barrel, thus preventing the barrel from lifting off with respect to the base disc. This locking is automatically out of action when the pot is at rest due to the spring back of the fingers which are fixed at one end only. Therefore fixing or removing the barrel while at rest is not affected in any way.

The locking mechanism may have spring loaded pins instead of the fingers.

The base disc of the pot is made by compression moulding suitable acid resistant materials or by injection moulding of glass filled thermoplastic materials like nylon, acetol, polycarbonate or polypropylene.

The base disc may have a layer of thin, smooth and acid resistant plastic film bonded to the top with a suitable adhesive which could be removed by solvent removal of the said adhesive.

The plastic film layer is of polyester, polypropylene, polyethelene, PTFE or such materials.

The adhesive used may be a hot salt thermoplastic, or a pressure sensitives elastomeric or any other polymeric adhesive like epoxides.

The base disc also has a disposable bush at the centre, which is accurately concentric to the spigot and the same gets its accurate location by being fitted into a close fitting bush which is integral with the base disc.

The integral bush is moulded as an insert and fine bored accurately concentric with respect to the spigot and is fitted into a moulded central cavity by adhesive bonding and then fine bored.

The disposable bush may be made of metallic materials, typically phospor bronze or of low friction non-metallic materials, typically PTFE.

The integral bush may be made of metallic materials, typically aluminium or of non-metallic materials, typically cloth laminated phenolin.

The external surface of the barrel as well as the internal surface are both made concentric to each other and to the spigot as also the axis of rotation. The surface finish of the barrel in new condition would be of mirror finish smoothness.

The concentricity of the pot is achieved by winding of the resin impregnated fibrous materials over a smooth mandrel and closing with an external mould with suitable smooth surface. The external mould will be located accurately concentric to the mandrel by means of locating diameters at both ends.

What is claimed is:

1. A spinning pot for twisting and winding synthetic textile yarns comprising:
   - a barrel defining two open ends;
   - a removable lid located at one end of the barrel spanning the diameter of the barrel and having a locating step concentric with the barrel;
   - a base plate slidingly supporting the edge of the other end of the barrel and projecting into the barrel concentrically with the barrel;
   - locking means projecting from the base plate into a corresponding recess defined by an inner wall of the barrel during rotation of the barrel to allow the barrel to expand uniformly without lifting off from the base plate; and
   - a bushing have a first member integral with the base plate and a second member fixed to a rotatable shaft of a motor, said second member engaging said first member for rotation of said barrel upon activation of said motor.

2. A spinning pot as defined in claim 1, wherein a funnel pipe extends through the lid into the barrel.

3. A spinning pot as claimed in claim 1, wherein the barrel is conically tapered outwardly from the base plate.

4. A spinning pot as defined in claim 1, wherein the barrel is of a cylindrical shape.

5. A spinning pot as defined in claim 1, wherein stiffening reinforcement members are located in the barrel for withstanding the stress on the barrel produced by the centrifugal force expanding the barrel during rotation.

6. A spinning pot as defined in claim 1, wherein the locking means includes a plurality of fingers projecting from the base plate during rotation and an annular groove defined by the barrel for receiving the plurality of fingers when projected from the base plate.

7. A spinning pot as defined in claim 1, wherein the locking means includes a spigot defined by the base plate having a tapering cross section and forming a joint between the base plate and the barrel.

8. A spinning pot as defined in claim 1, wherein the locking means includes a spigot defined by the base plate having a cylindrical cross section and forming a joint between the base plate and the barrel.

* * * * *